US009598753B2

(12) United States Patent
Kwak et al.

(10) Patent No.: US 9,598,753 B2
(45) **Date of Patent: *Mar. 21, 2017**

(54) HIGH STRENGTH THIN STEEL SHEET FOR THE SUPERIOR PRESS FORMABILITY AND SURFACE QUALITY AND GALVANIZED STEEL SHEET AND METHOD FOR MANUFACTURING THE SAME

(71) Applicant: POSCO, Pohang (KR)

(72) Inventors: Jai Hyun Kwak, Gwangyang (KR); Kwang Geun Chin, Gwangyang (KR)

(73) Assignee: POSCO, Pohang (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/919,820

(22) Filed: Oct. 22, 2015

(65) Prior Publication Data

US 2016/0040275 A1 Feb. 11, 2016

Related U.S. Application Data

(62) Division of application No. 12/989,214, filed as application No. PCT/KR2008/005130 on Sep. 1, 2008, now Pat. No. 9,194,030.

(30) Foreign Application Priority Data

May 19, 2008 (KR) ..... 10-2008-0046100

(51) Int. Cl.
*C22C 38/60* (2006.01)
*C21D 6/00* (2006.01)
(Continued)

(52) U.S. Cl.
CPC ..... *C22C 38/60* (2013.01); *C21D 6/001* (2013.01); *C21D 6/002* (2013.01); *C21D 6/005* (2013.01);
(Continued)

(58) Field of Classification Search
CPC ..... C21D 8/04; C21D 8/0426; C21D 6/005
See application file for complete search history.

(56) References Cited

U.S. PATENT DOCUMENTS 6,342,310 B2 1/2002 Hashimoto et al.
6,358,338 B1 3/2002 Guelton et al.
(Continued)

FOREIGN PATENT DOCUMENTS

JP 05070886 A 3/1993
JP 07138345 A 5/1995
(Continued)

OTHER PUBLICATIONS

Nagoya R&D Laboratory, Nippon Steel Corporation, "Effect of Microstructure on Formality and Delayed Cracking of Super High Strength Cold Steel Sheet", CAMP-ISIJ vol. 5 (1992), pp. 1839-1841 and English translation.
(Continued)

*Primary Examiner* — Rebecca Lee
(74) *Attorney, Agent, or Firm* — The Webb Law Firm

(57) ABSTRACT

A high strength thin steel sheet that is mainly used for structural members and inner and outer panels for a vehicle, a galvanized steel sheet, and methods of manufacturing the same. The high strength thin steel sheet for superior press formability includes, by weight percent, 0.06 to 0.4% C, 1.0 to 5.0% Mn, 0.05 to 2.5% Si, 0.01 to 2.0% Ni, 0.02 to 2% Cu, 0.01 to 0.04% Ti, 0.05 to 2.5% Al, 0.005 to 0.1% Sb, 0.0005 to 0.004% B, 0.007% or less N, and balance Fe and inevitable impurities, and meeting relation of Ni+0.5×Mn+0.3×Cu>0.9, which is defined as Ni*, and Al/Ni*<1.3 at a same time, and relation of Ti≥0.028×Al. This thin steel sheet is galvanized or galvannealed.

4 Claims, 3 Drawing Sheets

(51) Int. Cl.

| | |
|---|---|
| ***C21D 8/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/14*** | (2006.01) |
| ***C22C 38/16*** | (2006.01) |
| ***C22C 38/54*** | (2006.01) |
| ***C21D 9/46*** | (2006.01) |
| ***C22C 38/12*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/58*** | (2006.01) |
| ***C23C 2/02*** | (2006.01) |
| ***C23C 2/40*** | (2006.01) |
| *C21D 1/673* | (2006.01) |
| *C21D 8/02* | (2006.01) |

(52) U.S. Cl.

CPC ..... *C21D 6/008* (2013.01); *C21D 8/0263* (2013.01); *C21D 8/0426* (2013.01); *C21D 8/0436* (2013.01); *C21D 8/0473* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/42* (2013.01); *C22C 38/44* (2013.01); *C22C 38/48* (2013.01); *C22C 38/50* (2013.01); *C22C 38/54* (2013.01); *C22C 38/58* (2013.01); *C23C 2/02* (2013.01); *C23C 2/40* (2013.01); *C21D 1/673* (2013.01); *C21D 8/0226* (2013.01); *C21D 8/0236* (2013.01); *C21D 8/0478* (2013.01); *C21D 2211/001* (2013.01); *C21D 2211/002* (2013.01)

(56) References Cited

U.S. PATENT DOCUMENTS

| | | | |
|---|---|---|---|
| 6,911,268 | B2 | 6/2005 | Takada et al. |
| 7,416,615 | B2 | 8/2008 | Bano et al. |
| 7,780,799 | B2 | 8/2010 | Goto et al. |
| 2003/0116232 | A1 | 6/2003 | Marchionni et al. |
| 2004/0202889 | A1 | 10/2004 | Fujita et al. |
| 2005/0081966 | A1 | 4/2005 | Kashima et al. |
| 2006/0137769 | A1 | 6/2006 | Yuse et al. |
| 2006/0169367 | A1 | 8/2006 | Yuse et al. |
| 2008/0070060 | A1 | 3/2008 | Suzuki et al. |

FOREIGN PATENT DOCUMENTS

| | | | | |
|---|---|---|---|---|
| JP | 2001064750 | A | 3/2001 | |
| JP | 2001288550 | A | 10/2001 | |
| JP | 2002146477 | A | 5/2002 | |
| JP | 2002155317 | A | 5/2002 | |
| JP | 2002173737 | A | 6/2002 | |
| JP | 2002294397 | A | 10/2002 | |
| JP | 2003138345 | A | 5/2003 | |
| JP | 2004332099 | A * | 11/2004 | ..... C22C 38/00 |
| JP | 2004346362 | A | 12/2004 | |
| JP | 2005120436 | A | 5/2005 | |
| JP | 2005187837 | A | 7/2005 | |
| JP | 2006037201 | A | 2/2006 | |
| JP | 2006207019 | A | 8/2006 | |
| JP | 2007039780 | A | 2/2007 | |
| JP | 2007321168 | A | 12/2007 | |
| KR | 19980045322 | A | 9/1998 | |
| KR | 20000043762 | A | 7/2000 | |
| KR | 20040037963 | A | 5/2004 | |
| KR | 1020040088583 | A | 10/2004 | |
| KR | 1020050032721 | A | 4/2005 | |
| KR | 1020070067593 | A | 6/2007 | |
| WO | 2007067014 | A1 | 6/2007 | |
| WO | 2007074994 | A1 | 7/2007 | |

OTHER PUBLICATIONS

M. Nagumo, "Hydrogen related failure of steels—a new aspect", Materials Science and Technology (Aug. 2004), vol. 20, 8; ProQuest Science Journals, pp. 940-950.

Berrahmoune, M.R. et al., "Delayed cracking in 301LN austenitic steel after deep drawing: Martensitic transformation and residual stress analysis", Materials Science & Engineering (2006), pp. 262-266.

* cited by examiner

Inventive Steel5 Comparative Steel6

HIGH STRENGTH THIN STEEL SHEET FOR THE SUPERIOR PRESS FORMABILITY AND SURFACE QUALITY AND GALVANIZED STEEL SHEET AND METHOD FOR MANUFACTURING THE SAME

CROSS REFERENCE TO RELATED APPLICATIONS

This application is a divisional application of U.S. application Ser. No. 12/989,214 filed Sep. 1, 2008, which claims priority to International Application No. PCT/KR2008/005130 filed Sep. 1, 2008, and claims priority to Korean Patent Application No. 10-2008-0046100 filed May 19, 2008, the disclosures of which are hereby incorporated in their entirety by reference.

BACKGROUND OF THE INVENTION

Field of the Invention

The present invention relates to a high strength thin steel sheet that is mainly used for structural members and inner and outer panels for a vehicle, a galvanized steel sheet, and methods of manufacturing the same, and more particularly, to a high strength thin steel sheet for superior press formability and surface quality, which has superior corrosion resistance, press formability, and galvanizability to a known high strength thin steel sheet, thereby increasing corrosion resistance of a vehicle body to lead to high safety of a passenger and high durability of the vehicle body, a galvanized steel sheet, and a method of manufacturing the same.

Description of Related Art

It is already well-known that recent steel sheets for vehicles are gradually increased in strength due to a demand for reduction in fuel cost as well as higher safety of a passenger in the event of collision, are required to have a higher level of formability due to a tendency toward complication and integration of vehicle parts, and are required to have excellent secondary working brittleness resistance, superior fatigue characteristics of a weld zone, and beautiful plated surface in the terms of the environments in which the vehicles are used. As well-known up to now, in order to increase formability and strength, the steel sheets are generally manufactured by adding structure reinforcement elements such as C, Si, Mn, Ti, Al and so on. These elements function to form a metastable transformation structure during quenching, martensite or bainite or austenite retained to room temperature (hereinafter, referred to as "retained austenite" without transforming austenite formed at high temperature into ferrite and cementite, or pearlite at room temperature, thereby obtaining appropriate strength and ductility.

According to the disclosures of Japanese Patent Publication Nos. 2005-187837 and 2004-346362, C, Si and Mn are main components, and either a solution strengthening element, P, causing press formability for strength to be less reduced or Al having characteristics similar to Si is added. Contents of Si and Al are limited, and B or various components such as rare earth metals are added in order to improve working brittleness. However, the components other than the main components have an obscure effect, and description of some of the elements is far apart from typical metallurgical knowledge. For example, in the case of B, since C contained in high strength steel at a great amount can sufficiently prevent grain boundary embrittlement, a quench hardening effect is further increased due to B. As a result, B shows a tendency to deteriorate the working brittleness.

Further, according to the disclosure of Japanese Patent Publication No. 2000-368317, restrictions are intentionally imposed on composition and production conditions in order to improve press formability with a composition nearly similar to the aforementioned known technologies. This also has a little effect. In fact, in the continuous casting-hot rolling process, these elements degrade high-temperature ductility to weaken steel at high temperature, and cause surface enrichment during cold-rolled annealing because they have higher oxygen affinity in comparison with Fe. Thus, these elements generate bare spots, and thus readily deteriorate plating quality. Furthermore, when the surface enrichment is coarsened, it is adsorbed to the hearth roll of a continuous annealing line, and thus is apt to cause micro-dents in the surface of a plated steel sheet.

In order to cope with the plating defects as described above, technology for manufacturing a high strength thin steel sheet for high press formability is disclosed in Japanese Patent Publication Nos. 2002-146477, 2001-64750, 2002-294397, 2002-155317 and 2001-288550. Describing the disclosures in brief, specific elements such as Cr, Sb, Sn, etc. are added to improve platability, or a hot-rolled coil is previously oxidized prior to cold rolling, thereby inhibiting the surface enrichment formed during cold rolling annealing. However, these disclosures fail to give a positive effect of adding the specific elements or a definite study on metallurgical behaviors of the added elements, and thus do not give a complete manufacturing method required to obtain the effect. Furthermore, some of the disclosures are directed to the manufacturing method that cannot be implemented using current typical hot rolling-cold rolling-continuous annealing equipment, so that they do not applied to actual commercial production.

SUMMARY OF THE INVENTION

Technical Problem

Embodiments of the present invention provide a high strength thin steel sheet that has superior press formability as well as superior corrosion resistance and surface characteristics when galvanized, as compared to a conventional high strength steel sheet, by metallurgically analyzing an influence of alloy elements departing from suggesting the alloy components on the basis of partially empirical or conceptual insistence in the prior art and by properly controlling alloy components of steel on the basis of the analyzed results, a galvanized steel sheet using the same, and methods of manufacturing the same.

Technical Solution

According to an aspect of the present invention, there are provided a high strength thin steel sheet for superior press formability includes, by weight percent, 0.06 to 0.4% C, 1.0 to 5.0% Mn, 0.05 to 2.5% Si, 0.01 to 2.0% Ni, 0.02 to 2% Cu, 0.01 to 0.04% Ti, 0.05 to 2.5% Al, 0.005 to 0.1% Sb, 0.0005 to 0.004% B, 0.007% or less N, and balance Fe and inevitable impurities, and meeting relation of $Ni+0.5\times Mn+0.3\times Cu\geq 0.9$, which is defined as Ni*, and $Al/Ni^{*}\leq 1.3$ at a same time, and relation of $Ti\geq 0.028\times Al$, and a galvanized steel sheet in which the thin steel sheet is galvanized or galvannealed.

According to another aspect of the present invention, there is provided a method of manufacturing a high strength thin steel sheet for superior press formability. The method includes hot-working a steel slab, which comprises, by weight percent, 0.06 to 0.4% C, 1.0 to 5.0% Mn, 0.05 to 2.5% Si, 0.01 to 2.0% Ni, 0.02 to 2% Cu, 0.01 to 0.04% Ti, 0.05 to 2.5% Al, 0.005 to 0.1% Sb, 0.0005 to 0.004% B, 0.007% or less N, and balance Fe and inevitable impurities, and which meets relation of $Ni+0.5\times Mn+0.3\times Cu\geq 0.9$, which is defined as Ni*, and $Al/Ni^*\leq 1.3$ at a same time, and relation of $Ti\geq 0.028\times Al$, at a temperature above Ar3, hot-rolling winding the hot-wrought steel slab at a temperature between 500° C. and 700° C., pickling and cold rolling the wound steel slab, annealing the cold-rolled steel slab at a temperature at which a fraction of austenite has at least 30%, and quenching the annealed steel slab from a temperature direct above a martensite forming temperature to a temperature below a bainite forming temperature, and cooling the quenched steel slab after at least 30 seconds.

According to another aspect of the present invention, there is provided a method of manufacturing a galvanized high strength steel sheet for superior press formability, which includes galvanizing or galvannealing the high strength thin steel sheet manufactured by the aforementioned method.

Advantageous Effects

As set forth above, the high strength thin steel sheet represents excellent press formability due to excellent high-temperature ductility, is free from defects such as craters on the surface of the cold-rolled steel sheet or galvanized steel sheet due to no slab surface crack, and inhibits a dent defect, so that it has excellent corrosion resistance and surface characteristics when galvanized.

DESCRIPTION OF THE INVENTION

Figure 1:
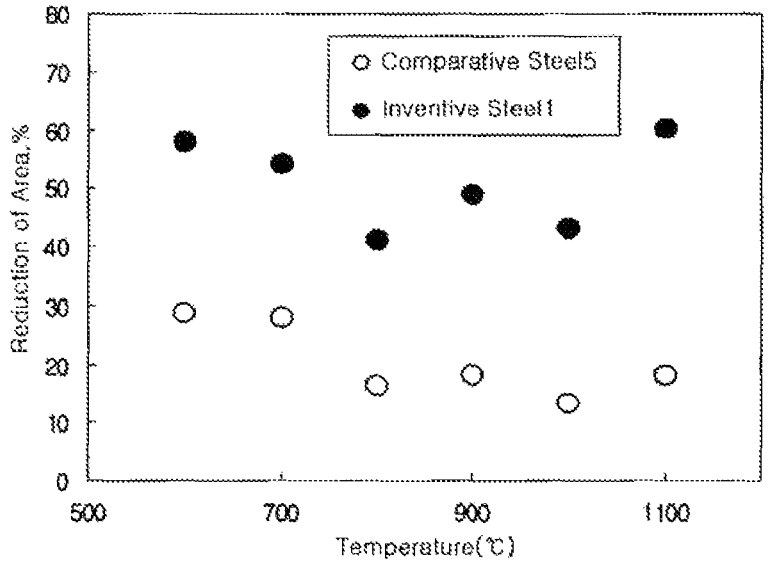
FIG. 1 is a graph showing reduction of area depending on temperature with respect to steel to which B is added and steel to which B is not added.

A high strength thin steel sheet for superior press formability includes, by weight percent, 0.06 to 0.4% C, 1.0 to 5.0% Mn, 0.05 to 2.5% Si, 0.01 to 2.0% Ni, 0.02 to 2% Cu, 0.01 to 0.04% Ti, 0.05 to 2.5% Al, 0.005 to 0.1% Sb, 0.0005 to 0.004% B, 0.007% or less N, and balance Fe and inevitable impurities, and meets the relation of $Ni+0.5\times Mn+0.3\times Cu\geq 0.9$, which is defined as Ni*, and $Al/Ni^*\leq 1.3$ at a same time, and relation of $Ti\geq 0.028\times Al$ The composition of the high strength thin steel sheet will be described below in detail on the basis of weight percent.

A content of C ranges from 0.06 to 0.4%. C is enriched into an austenite phase in the event of annealing, slow cooling, and quenching on a two-phase region, and in the event of austempering on a bainite region, thereby contributing to lowering transformation temperature of austenite into martensite below room temperature.

When the content of C is less than 0.06%, this makes it impossible to secure sufficient tensile strength due to grain growth as well as reduction in solution and participation strengthening effects caused by carbon. In contrast, when the content of C is more than 0.4%, this increases tensile strength due to a solution strengthening effect and an increase in a large quantity of retained austenite, and causes transformation induced plasticity of the large quantity of retained austenite into martensite after deformation, so that solution of hydrogen in steel is sharply reduced, a phenomenon such as delayed fracture occurs at a finished part. A high content of C causes weldability to be greatly reduced. Thus, the content of C is limited to the range from 0.06 to 0.4%.

A content of Mn ranges from 1.0 to 5.0%. Mn contributes to stabilization of austenite in transformed steel together with solution strengthening. If the content of Mn increases, martensite and bainite transformation temperatures are lowered. The reduction in the martensite formation temperature is regarded to be very important in steel based on retained austenite. When austenite, which is retained in the process of cooling the steel to room temperature after heat treatment, is transformed into martensite, the retained austenite disappears, which leads to an increase in strength but a great decrease in ductility.

Thus, it is necessary to greatly lower the martensite transformation temperature. For this reason, when the content of Mn is less than 1.0%, its effect is insignificant. In contrast, when the content of Mn is more than 5.0%, this increases hardenability too much. As a result, the strength of steel is greatly increased to make cold rolling difficult. Due to a cooling difference between the edge portion and the central portion of a hot rolled steel sheet, a martensite structure is developed at the edge portion, so that there is a high tendency toward fracture of the steel sheet during cold rolling. Further, a plated steel sheet undergoes remarkable reduction in press formability for strength. Thus, a value of elongation×tensile strength is remarkably reduced, and the weldability of steel becomes bad. Thus, the content of Mn is limited to the range from 1.0 to 5.0%.

A content of Si ranges from 0.05% to 2.5%. In an annealing process, part of austenite is transformed into bainite during cooling, so that carbon is diffused into the austenite. Thus, an amount of carbon in the austenite is increased, and then retained austenite is stabilized. Si acts to inhibit precipitation of carbide from the bainite, and thus requires a content of 0.05% or more. However, when the content of Si exceeds 2.5%, surface quality is deteriorated. Thus, the content of Si has the upper limit of 2.5%.

Ni is one of very important elements in an embodiment of the present invention. A content of Ni ranges from 0.01 to 2.0%. Ni functions to expand an austenite region, and particularly to prevent reduction in austenite region or in fraction of austenite at an annealing temperature on a two-phase region depending on an amount of added Al.

In this embodiment, other elements taking this role include Mn and Cu. Mn promotes grain boundary embrittlement, and Cu causes grain boundary erosion of liquid Cu metal when reheated. As such, Mn and Cu cannot be added at a large amount in order to ensure the surface quality. The only alternative element is Ni. In this embodiment, since ferro-nickel is expensive to have a problem with an increase in cost, Ni is added in consideration of a content of Al. When the content of Ni is less than 0.01%, this makes it difficult to expect the aforementioned effects. In contrast, when the content of Ni is more than 2.0%, this increases the cost. Thus, the content of Ni is limited to the range from 0.01 to 2.0%.

A content of Cu ranges from 0.02 to 2.0%. Like Ni, Cu expands austenite, and is added along with Si and Al, thereby coping with reduction in austenite region. Thus, it is necessary to add Cu by 0.02% or more. However, if Cu is added beyond 2.0%, Cu is reduced from high-temperature iron oxide formed on a surface layer to liquid metal, and penetrates an austenite grain boundary to cause brittleness of the liquid metal.

Of course, if Ni is added at a proper amount, this acts to increase solubility of Cu in Fe, so that the brittleness of the liquid metal is inhibited, but the cost is increased. Thus, Ni cannot be excessively added. For this reason, the content of Cu has the upper limit of 2.0%.

A content of Al ranges from 0.05 to 2.5%. Al generates a bare spot when Si is excessively added, and thus functions to complement necessary Si. Most of the known technologies are based on a method of excessively adding Si, whereas, in this embodiment, since ferro-silicon is inexpensive, Si is added only up to the range within which surface quality of plating is ensured. When further required to stabilize austenite, Si is replaced by Al. Thus, the least content of required Al is set to 0.5%. However, if Al is excessively added, this causes an increase in cost as well as expansion of a ferrite fraction, which leads to a decrease in austenite and an increase in density of MN precipitate. This results in decreasing ductility. Thus, the content of Al has the upper limit of 2.5%.

A content of Ti ranges from 0.01 to 0.04%. Ti inhibits carbide from being formed in ferrite by addition of Al, and thus maximizes a content of carbon in austenite. Thereby, Ti enhances stabilization of retained austenite. As such, in this embodiment, Ti is the most important element, and must be added. Al is partially used to precipitate MN by bonding with N. As in this embodiment, if the content of Al is high, AlN is formed at high temperature, at high density, and with a large grain size, and thus provides a site where a microvoid is generated to decrease elongation.

Thus, Ti is added so as to remarkably reduce the density of nitride precipitate such as MN by coarsening the nitride precipitate. When the content of Ti exceeds 0.01%, TiN is formed prior to AlN, and is left behind without being dissolved again during reheating a slab, so that the grain growth of austenite is inhibited before hot rolling is performed, and thus grain refinement of a hot-rolled steel sheet occurs. However, when the content of Ti is too high, this causes an increase in cost as well as in density of coarse precipitate, and thus the elongation is reduced again. Thus, the content of Ti has the upper limit of 0.04%.

A content of Sb ranges from 0.005 to 0.1%. In this embodiment, Sb is one of the most important elements. Sb itself does not form an oxide thin film at high temperature, but is enriched into a surface and grain boundary. Thereby, Sb inhibits constituent elements in steel from being diffused onto the surface, which results in inhibiting creation of oxide. Sb is added to inhibit the creation of oxide during annealing along with Si, Mn and Al added at a high content, so that Sb remarkably improves platability. Particularly, in the case in which Mn and B are mixed and added, Sb effectively inhibits coarsening of a surface oxide layer. When coarsened, an annealed oxide is repetitively stacked on a roll installed in a continuous annealing furnace, thereby causing a dent defect on the surfaces of a cold-rolled and plated material. The inhibition of surface oxide attributable to the addition of Sb is very effective against the inhibition of this dent defect.

Sb added at a proper amount increases strength and ductility of steel at the same time, and thus is effective against improvement of mechanical properties. In addition, it is found that Sn, Se, Y, etc. have a similar effect, but have higher surface enrichment as compared to other elements. Among them, Se and Y have a possibility of generating oxide under a surface layer of $SiO_2$ or $Al_2O_3$ to thereby coarsen the oxide. Thus, the addition of Sb has a remarkable effect against the surface enrichment of MnO, $SiO_2$, $Al_2O_3$, etc. during annealing a cold-rolled steel sheet, and can improve the mechanical properties. In order to produce these effects, Sb of at least 0.0005% is required. If Sb is added beyond a specified limit, such effects cannot be produced. Thus, the content of Sb is limited to the upper limit 0.1%.

A content of B ranges from 0.0005 to 0.004%. B is added to improve high-temperature ductility of steel and inhibit formation of ferrite or pearlite during cooling. B plays a most important role in precipitation at an austenite grain boundary, is inhibited from surface diffusion by Sb, and has higher grain boundary concentration in comparison with conventional steel. Afterwards, when the steel is cooled, ferrite nucleation and growth occur at the austenite grain boundary. In the case in which the austenite grain boundary is stabilized by B, the ferrite nucleation does not easily occur, and thus transformation is delayed. At this time, when stress is slightly applied at a lower temperature, dislocation density is increased in a grain, and thus transformation induced plasticity occurs, so that a large quantity of ferrite appears at the grain boundary and in the grain. As a result, the inhibited ferrite transformation is abruptly increased. High-temperature embrittlement concentrates deformation on the ferrite precipitated at the austenite grain boundary in a film state, and thereby generates a crack. When the large quantity of ferrite abruptly appears at the grain boundary and in the grain, an amount of deformed ferrite is increased, so that the ductility of steel is increased at a given strain.

In this manner, in order to ensure the high-temperature ductility, B of 0.0005% or more is required. However, In a transformation structure after annealing, fine bainite is formed at the grain boundary and in the grain. Thus, when B is added too much, the ductility of steel is deteriorated. For this reason, the content of B has the upper limit of 0.004%.

A content of N is set to 0.007% or less. N is an element that is effective for stabilizing austenite. However, when N is added too much, N is bonded with Al or Ti, so that a density of MN or TiN precipitate is increased to deteriorate the ductility of steel. Thus, the content of N is limited to 0.007% or less.

The aforementioned composition may include at least one selected from the group consisting of Cr, Mo and Nb. Hereinafter, a detailed description will be made regarding Cr, Mo and Nb.

A content of Cr ranges from 0.01 to 1.0%. Cr is also added to improve the strength of steel. Since Cr inhibits formation of oxide during annealing at high temperature, Cr improves wettability with respect to a steel sheet when the steel sheet is galvanized. In order to obtain these effects, Cr of at least 0.01% is required. However, if Cr is added beyond a specified limit, the elongation of steel is greatly reduced. Thus, the content of Cr has the upper limit of 1.0%.

A content of Mo ranges from 0.005 to 0.3%. Mo is added to improve secondary working brittleness resistance and platability. When the content of Mo is less than 0.005%, a desired effect is not produced. Further, when the content of Mo exceeds 0.3%, this greatly reduces such an improving effect and is unfavorable in the economical aspect.

A content of Nb ranges from 0.001 to 0.1%. Nb is in a state dissolved in steel, or is effective for increasing strength of a steel sheet and refining a grain size by forming NbC. When the content of Nb is less than 0.001%, it is difficult to produce such an effect. In contrast, when the content of Nb exceeds 0.1%, this causes an increase in cost of production and excessive precipitate, and thus deteriorates ferrite ductility. Thus, the content of Nb is preferably limited to the range from 0.001 to 0.1%.

According to an embodiment of the present invention, the high strength thin steel sheet meets the following relation:

$$Ni+0.5\times Mn+0.3\times Cu\geq 0.9 \text{ (equivalent of Ni)},$$

(hereinafter, the equivalent of Ni will be expressed by Ni*). As described above, the amount of added Ni corresponds to the total amount of elements having similar effects. The result of testing an influence of Mn, Cu and Ni exercised on increasing a fraction of austenite shows that, when Ni of 1% and Mn of 2%, or Cu of 3.3% is added within the content of C meeting this embodiment, the fraction of austenite is identically affected.

For example, assuming that the influence of Ni exercised on increasing the fraction of austenite is 1, Mn is 0.5, and Cu is 0.3. This relation is expressed by $Ni+0.5\times Mn+0.3\times Cu$ (Ni*). When Ni* is small, the amount of added Ni must be equally reduced in order to ensure the fraction of austenite during annealing, so that the stabilization of austenite is greatly reduced. Thus, in order to ensure a sufficient austenite fraction of 30% or more during annealing, a value of Ni* is set to 0.9 or more.

According to an embodiment of the present invention, the high strength thin steel sheet meets the following relation: $Al/Ni^*\leq 1.3$. As described above, when the content of Al is arbitrarily added within the aforementioned range, this may give rise to a problem in ensuring the fraction of austenite during annealing. Thus, when a ratio of Al increasing a fraction of ferrite to Ni* increasing the fraction of austenite, i.e. the value of Al/Ni*, is limited to 1.3 or less, the fraction of austenite transformed during annealing can be obtained up to 30% or more.

According to an embodiment of the present invention, the high strength thin steel sheet meets the following relation: $Ti\geq 0.028\times Al$. When the content of Ti is low, MN is precipitated prior to TiN at a temperature higher than that at which TiN is precipitated. In the event of press forming, fine AlN forms microvoids to easily propagate a crack. As such, when coarse TiN is precipitated prior to MN at a temperature higher than that at which MN is precipitated, N dissolved is exhausted, and thus MN is not precipitated. Thus, according to embodiment of the present invention, in order to accomplish an adding effect of Al caused by preferential precipitation of TiN, as a result of yielding at least content of Ti obtained through calculation and test on the basis of thermodynamic data of AlN and TiN precipitation, the content of Ti is preferably 0.025 times of the content of Al.

Now, a manufacturing method according to an embodiment of the present invention will be described in detail.

Steel having the aforementioned composition is produced using an electric furnace or a converter, and is formed into a slab using ingot casting or continuous casting. Then, the slab is heated again at a temperature between 1100° C. to 1250° C., and then is hot-rolled at a temperature higher than the transformation point of Ar3, because there is a high possibility of hot deformation resistance being sharply increased at a finish hot rolling temperature, i.e. at a temperature lower than the transformation point of Ar3, and because there is a high possibility of generating microcracks due to high-temperature embrittlement.

After the finish hot rolling is completed, the hot-rolled steel sheet is wound at a temperature between 500° C. to 700° C. In this manner, the winding temperature is limited, because it is very important to ensure optimal strength and ductility and to realize an adding effect of Sb. Si, Mn and Al in steel react with an oxide scale (FeO) after winding, thereby forming oxides at a scale/metal interface.

This formation of the Si, Mn and Al oxides has a strong influence on concentrations of constituent elements of a metal outermost surface layer. As a result of repeating the test after Sb is added, when the winding is carried out at a temperature of 500° C. or less, the concentrations of Si, Mn and Al of the metal outermost surface layer is too high to realize an inhibiting effect of oxide based on Sb, and low-temperature transformation structures, particularly bainite and part of martensite, are formed by quenching, thereby making cold rolling difficult. In contrast, when the winding is carried out at a temperature of 700° C. or more, internal oxidation depths of Si, Mn and Al are excessive, which has an adverse influence on surface roughness and picklability.

Thus, the hot rolling winding temperature is limited to the range between 500° C. to 700° C. in order to produce the adding effect of Sb within the constituent ranges of Si, Mn and Al as described above.

The hot rolled steel sheet formed by this process is pickled and cold-rolled to a target thickness, and then is annealed for recrystallization and removal of microstructure defects such that a fraction of austenite is more than 30% at a temperature on a two-phase region where ferrite and austenite exist in common.

This annealing causes carbon to be enriched into the austenite that newly appears on the two-phase region, so that the formation of martensite is inhibited. Further, the stabilization of austenite is increased, so that an amount of retained austenite is increased to provide excellent press formability.

After annealing, the steel sheet is quenched from a temperature direct above a martensite forming temperature to a temperature below a bainite forming temperature, and then is cooled after maintained at a constant temperature for at least 30 seconds. In this process, the austenite formed during annealing is decomposed into the bainite and retained austenite again. Due to this decomposition, a concentration of carbon in the austenite is further increased, so that the stabilization of the retained austenite is further increased. This retained austenite is transformed into martensite at room temperature by deformation, so that the ductility is increased.

The cold-rolled steel sheet is manufactured as described above, or the cold-rolled steel sheet is subjected to galvanizing, or galvanizing and alloying treatment using a typical method after maintained at a constant temperature as described above, so that a plated steel sheet having superior plating surface characteristics. Preferably, the galvanizing is carried out in a hot dip galvanizing bath between 400° C. to 500° C., and then the alloying treatment is carried out at a temperature of 500° C. to 580° C.

The cold-rolled steel sheet or galvanized steel sheet manufactured using the aforementioned method has a fine grain due to a synergy effect between Al, Ni and B and Mn and Si, and is composed of ferrite as a matrix structure, austenite having a fraction of at least 30%, and bainite having the other fraction. The short side of an austenite lath contained in the bainite structure is designed so as to have 350 nm or less. In this case, the strength and ductility are excellent, and the slab has no surface crack, so that the surface of the cold-rolled steel sheet or galvanized steel sheet is free from defects such as craters. Further, an average diameter of oxide generated on the surface of the steel sheet is about 1 mm, and thus it is possible to prevent a defect impressed on the surface of the steel sheet (hereinafter, referred to as "dent defect") by annealed oxide adsorbed to the roll of an annealing furnace when the galvanized steel sheet is manufactured. In addition, the steel sheet has superior external appearance and surface adhesiveness.

Examples of the present invention will be described below in detail.

EXAMPLES

A steel slab having a composition as in Table 1 below was heated to a temperature of 1200° C., was extracted, and was hot-rolled at a temperature between 1050° C. and 900° C. so as to have a thickness of 3.2 mm. As shown in Table 2 below, the hot-rolled steel sheet was wound at a temperature between 500° C. and 600° C., was subjected to removal of high-temperature iron oxides from the surface thereof using 10% HCl solution, and was cold-rolled so as to have a thickness of 1.2 mm. Thereby, the cold-rolled steel sheet was manufactured.

After cold rolling, the cold-rolled steel sheet was annealed under atmosphere of $N_2$-10% $H_2$ at a temperature of 800° C. for 60 seconds, was slowly cooled to a temperature between 600° C. and 800° C., was quenched to a temperature between 400° C. and 480° C., was maintained at a constant temperature for a time between 30 sec and 100 sec, and was cooled to room temperature. Thereby, the cold-rolled steel sheet was manufactured. Alternatively, the cold-rolled steel sheet was annealed under atmosphere of $N_2$-10% $H_2$ at a temperature of 800° C. for 60 seconds, was slowly cooled to a temperature between 600° C. and 800° C., was quenched to a temperature between 400° C. and 480° C., was maintained at a constant temperature for a predetermined time, was galvanized in a hot dip galvanizing bath between 400° C. and 500° C., was subjected to alloying treatment at a temperature between 500° C. and 580° C., and was cooled to room temperature. Thereby, the cold-rolled steel sheet was manufactured.

The steel sheets manufactured using this method were measured with respect to mechanical properties, and their results were shown in Table 2 below. As shown in Table 2 below, the inventive steels represented very excellent properties: very high strength of 780 MPa or more; elongation of 24% or more; and a value of tensile strength×elongation of 25,000 or more, while the comparative steels represented low strength, low elongation, and a value of tensile strength×elongation of about 25,000. Thus, it could be found that the comparative steels had low elongation in comparison with the same level of inventive steel.

TABLE 2

| | CT | AT | A1 | A3 | X % | TS | El | TS × El |
|---|---|---|---|---|---|---|---|---|
| I.S. 1 | 550 | 800 | 716.8 | 913.4 | 48.4 | 986.1 | 26 | 25648 |
| I.S. 2 | 600 | 800 | 669.7 | 919.1 | 42 | 786.5 | 36.3 | 28535 |
| I.S. 3 | 520 | 800 | 720 | | 33.7 | 1037.3 | 29.1 | 30235 |
| I.S. 4 | 540 | 800 | 701.2 | 942.5 | 54.4 | 1112.3 | 24.7 | 27501 |
| I.S. 5 | 480 | 800 | 731.9 | 1154 | 34.8 | 1150.0 | 26.6 | 30640 |
| C.S. 1 | 540 | 800 | 730.1 | 947.4 | 36.9 | 894.7 | 26.5 | 23743 |
| C.S. 2 | 560 | 800 | 714.7 | 1019 | 42.3 | 1038.1 | 26.8 | 27829 |
| C.S. 3 | 600 | 800 | 748.4 | | 6.1 | 637.7 | 33.3 | 21246 |
| C.S. 4 | 550 | 800 | 685.1 | | 19.9 | 760.2 | 32 | 24351 |
| C.S. 5 | 540 | 800 | 709.3 | 902.8 | 52.1 | 905.1 | 27.1 | 24496 |
| C.S. 6 | 550 | 800 | 699 | 993.4 | 40.6 | 914.6 | 28.6 | 26128 |
| C.S. 7 | 560 | 800 | 748.1 | | 27.5 | 961.0 | 26.9 | 25803 |

Note)
I.S. is short for inventive steel,
C.S. for comparative steel,
CT for cold rolling temperature,
AT for annealing temperature,
TS for tensile strength, and
El for elongation.

Meanwhile, comparative steel 5 and inventive steel 1, both of which have similar content of carbon were measured with respect to a reduction of area depending on temperature, and the measured results are shown in FIG. 1. In FIG. 1, the reduction of area was measured in such a manner that a rod-like specimen was heated to a temperature of 1300° C., was subjected to solution treatment for five minutes, was cooled to a predetermined temperature, was maintained for three minutes, was drawn at a deformation speed of 0.00084 per second until it was broken off, that a diameter of the specimen was measured, and that a radius difference after and before drawing was divided by a radius before drawing.

TABLE 1

| | I.S. 1 | I.S. 2 | I.S. 3 | I.S. 4 | I.S. 5 | C.S. 1 | C.S. 2 | C.S. 3 | C.S. 4 | C.S. 5 | C.S. 6 | C.S. 7 |
|---|---|---|---|---|---|---|---|---|---|---|---|---|
| C | 0.21 | 0.1 | 0.18 | 0.25 | 0.22 | 0.18 | 0.21 | 0.05 | 0.08 | 0.21 | 0.17 | 0.19 |
| Mn | 1.6 | 2.3 | 1.6 | 2.1 | 1 | 0.8 | 2.1 | 0.2 | 2.1 | 1.5 | 2 | 1 |
| Si | 1.5 | 0.8 | 1.3 | 1.6 | 1.5 | 1.3 | 1.6 | 1.3 | 0.05 | 1.3 | 1.3 | 1.5 |
| P | 0.02 | 0.05 | 0.03 | 0.02 | 0.02 | 0.03 | 0.02 | 0.02 | 0.08 | 0.05 | 0.01 | 1.03 |
| Ni | 0.09 | 0.04 | 0.02 | 0.5 | 0.6 | 0.2 | 0 | 0.03 | 0 | 0.2 | 0.3 | 0 |
| Al | 0.51 | 0.6 | 1.3 | 1 | 1.3 | 0.5 | 1 | 0.5 | 1.5 | 0.5 | 1 | 1.42 |
| Cu | 0.04 | 0.1 | 1 | 0.05 | 0.04 | 0.02 | 0.04 | 0 | 0.1 | 0.01 | 0.02 | 0.03 |
| Ti | 0.019 | 0.025 | 0.04 | 0.03 | 0.04 | 0.02 | 0.03 | 0 | 0.02 | 0 | 0.03 | 0.04 |
| B | 0.002 | 0.003 | 0.002 | 0.002 | 0.003 | 0.001 | 0.002 | 0.003 | 0.002 | 0 | 0.003 | 0.002 |
| N | 0.003 | 0.005 | 0.003 | 0.004 | 0.005 | 0.003 | 0.004 | 0.002 | 0.003 | 0.006 | 0.005 | 0.004 |
| Sb | 0.021 | 0.01 | 0.04 | 0.025 | 0.02 | 0.01 | 0.02 | 0 | 0.02 | 0.02 | 0 | 0.03 |
| Other | Cr 0.03 | Nb 0.03 | Mo 0.01 | | | Cr 0.05 | | | | | | |
| Ni* | 0.90 | 1.22 | 1.12 | 1.57 | 1.11 | 0.61 | 1.06 | 0.13 | 1.08 | 0.95 | 1.31 | 0.51 |
| Al/Ni* | 0.6 | 0.5 | 1.2 | 0.6 | 1.2 | 0.8 | 0.9 | 3.8 | 1.4 | 0.5 | 0.8 | 2.8 |
| Ti* | 0.014 | 0.017 | 0.036 | 0.028 | 0.036 | 0.014 | 0.028 | 0.014 | 0.042 | 0.014 | 0.028 | 0.040 |

Note)
I.S. is short for inventive steel, and
C.S. is short for comparative steel.

The higher the reduction of area is, the more excellent the ductility may be. Thus, no crack was generated in the event of high-temperature press forming. As shown in FIG. 1, it can be found that inventive steel 1 has the reduction of area of 40% or more, and that the high-temperature ductility is excellent. A content of Al of inventive steel 1 was similar to that of comparative steel 5, but comparative steel 5 was not added with B and Ti. Thus, it can be found from FIG. 1 that the high-temperature ductility is remarkably improved by addition of B, and that the crack can be inhibited from being formed on the surface of the slab.

Figure 2:
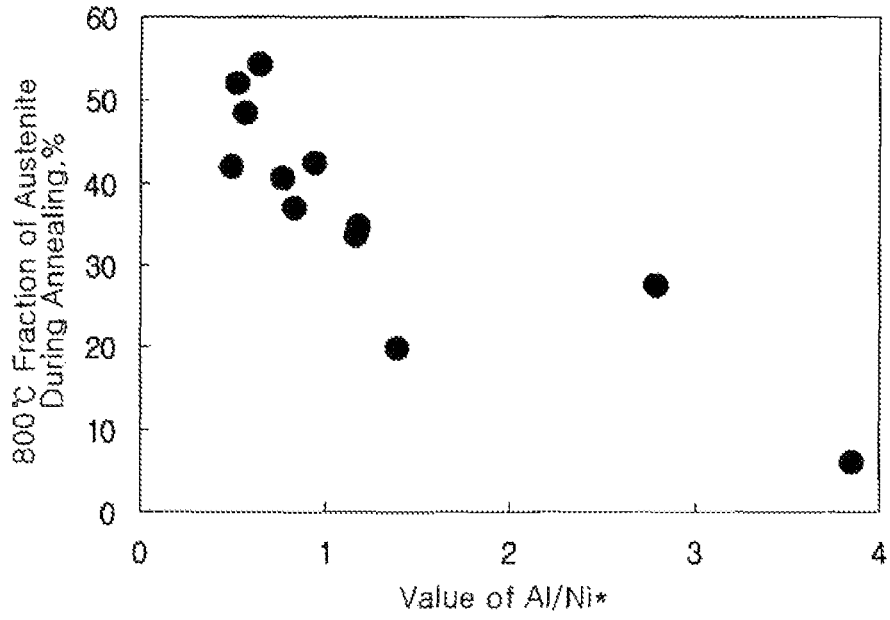
FIG. 2 is a graph showing a fraction of austenite during annealing at a temperature of 800° C. depending on a value of Al/Ni*.

The fraction of austenite during annealing at a temperature of 800° C. according to a value of Al/Ni* is shown in FIG. 2. The results of FIG. 1 were measured through a linear expansion test. As shown in FIG. 2, in the case of the invention steels in which the value of Al/Ni* is limited to 1.3, the content of austenite is obtained up to 30% or more, so that the finally left amount of retained austenite is increased. Thus, it can be found that the elongation for the strength is excellent. This result shows that, when a value of Ni* is controlled in order to solve a contradiction in that Al, an element for increasing the ferrite region, contributes to inhibiting carbide and increasing activity of a carbon atom but reducing the austenite region, the fraction of austenite is increased.

Figure 3:
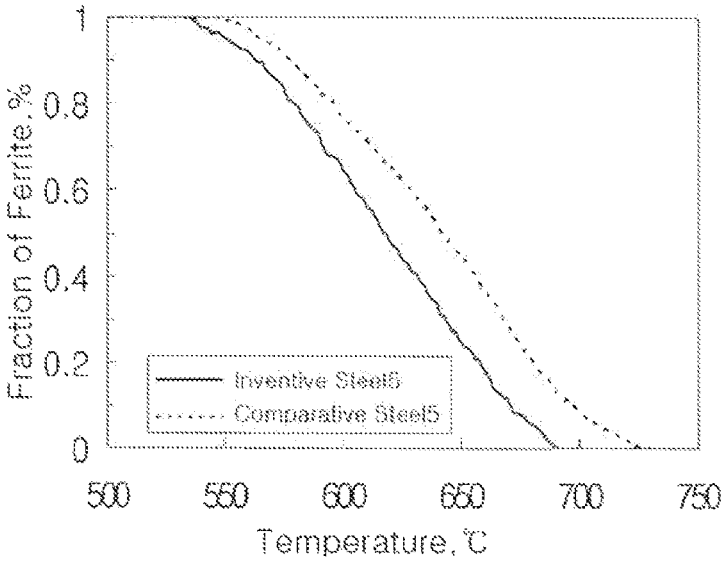
FIG. 3 is a graph showing a speed at which ferrite is formed again during cooling with respect to steel to which B is added and steel to which B is not added.

FIG. 3 shows the results of measuring a fraction of ferrite newly formed from austenite wherein the austenite is set to 100 in order to represent a speed at which the austenite is transformed into ferrite again during cooling after annealing of inventive steel 5 to which B is added and comparative steel 5 to which B is not added. In detail, when annealed at a temperature of 800° C. and then maintained for 60 seconds, a cold-rolled steel sheet forms austenite from the ferrite while being recrystallized. When the recrystallized cold-rolled steel sheet is cooled again, carbons move toward the austenite at a boundary between the ferrite and the austenite, and the ferrite grows again.

It can be found from FIG. 3 that inventive steel 5 delays re-formation of new ferrite due to segregation of B. Thus, it can be found that the fraction of austenite retained prior to quenching is maximized in the steel to which B is added, and thus the strength and ductility are improved.

Figure 4:
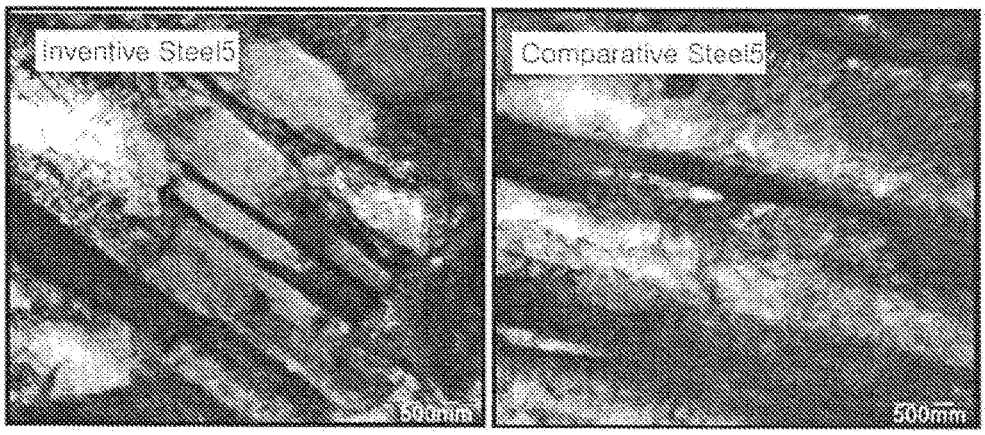
FIG. 4 shows photographs of steel to which Al and B are added and steel to which Al and B are not added with respect to the size of a lath of retained austenite.

FIG. 4 shows photographs of inventive steel 5 and comparative steel 5 photographed by a transmission electron microscope in order to check a size of the austenite finally obtained after the steels are cooled to room temperature. Even in the case in which two steels have the same contents of C and Al, stability of an interface between ferrite and austenite is increased by addition of B, nucleation of bainite occurs at a lower temperature, and is delayed. As shown in FIG. 4, a finer austenite lath is obtained from inventive steel 5. This lath has a size of about 350 nm. Since a path along which carbons moves from bainite to austenite is short, a still more amount of carbons are enriched into the austenite having a narrow lath, and thus increases stability of austenite. Thus, it can be found that the strength and ductility of the steel are further increased.

Figure 5:
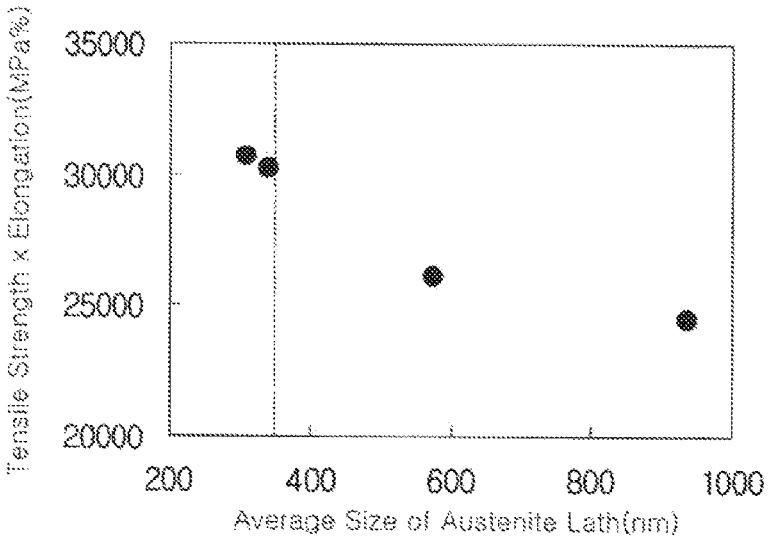
FIG. 5 is a graph shown a value of tensile strengthxelongation depending on the size of a lath of austenite.

The size of the austenite lath was measured three times. An average value of the measured sizes was obtained, and then was compared with a value of tensile strength×elongation, which was an index of indicating both of strength and ductility of the steel. The results are shown in FIG. 5. In inventive steels 3 and 5 meeting the value of Al/Ni*, the austenite lath is less than 350 nm, and the value of tensile strength×elongation is more than 30,000. In comparative steels 5 and 7, the austenite lath is less than 550 nm, and the value of tensile strength×elongation is about 25,000.

Figure 6:
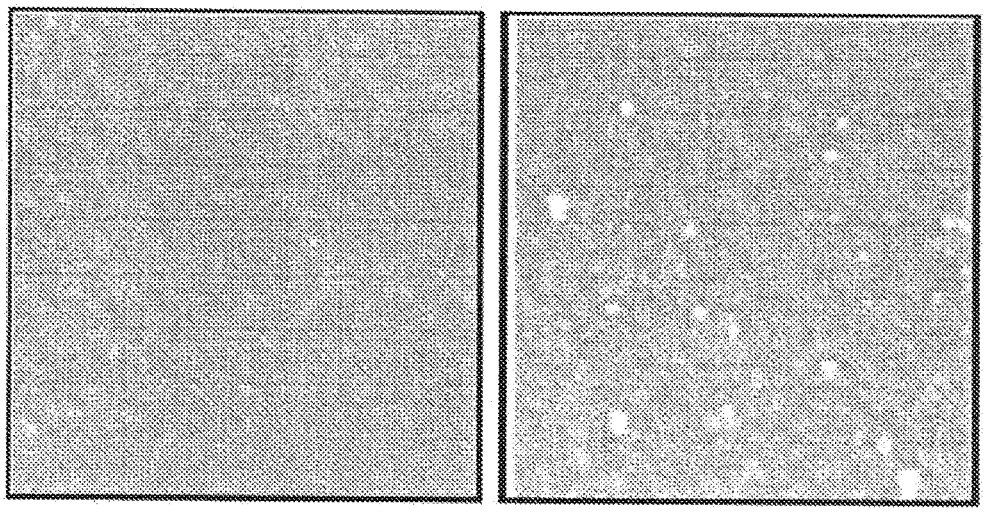
FIG. 6 shows photographs of steel to which Sb is added and steel to which Sb is not added with respect to an external appearance of a galvanized layer.

FIG. 6 shows photographs of inventive steel 5 to which Sb is added and comparative steel 6 to which Sb is not added in order to check whether or not a bare spot occurs. It is checked that a plated surface is excellent in the case of inventive steel 5, and that plating defects such as a bare spot occur in the case of comparative steel 6. Thus, in the annealing process of the steel in which Mn, Si and Al are contained at a large amount, oxide is inhibited by addition of Sb. Thus, it can be found that the platability is remarkably improved by the addition of Sb. Particularly, it can be found that coarsening of a surface oxide layer can be effectively inhibited when Mn and B are mixed and added.

The invention claimed is:

1. A method of manufacturing a high strength thin steel sheet for superior press formability, the method comprising:

hot-working a steel slab, which comprises, by weight percent, 0.06 to 0.4% C, 1.0 to 5.0% Mn, 0.05 to 2.5% Si, 0.01 to 2.0% Ni, 0.02 to 2% Cu, 0.01 to 0.04% Ti, 0.05 to 2.5% Al, 0.005 to 0.1% Sb, 0.0005 to 0.004% B, 0.007% or less N, and balance Fe and inevitable impurities, and which meets relation of $Ni+0.5\times Mn+0.3\times Cu\geq 0.9$, which is defined as Ni*, and $Al/Ni^*\leq 1.3$ at a same time, and a relation of $Ti\geq 0.028\times Al$, at a temperature above Ar3;

hot-rolling the steel slab to form a hot-rolled steel sheet and coiling the hot-rolled steel sheet at a temperature between 500° C. and 700° C.;

pickling and cold rolling the hot-rolled steel sheet to form a cold-rolled steel sheet;

annealing the cold-rolled steel sheet at a temperature at which a fraction of austenite has at least 30%; and quenching the annealed steel sheet from a temperature directly above a martensite forming temperature to a temperature below a bainite forming temperature, maintaining the quenched steel sheet at the temperature below the bainite forming temperature for at least 30 seconds, and cooling the quenched and maintained steel sheet, wherein the cooled steel sheet comprises austenite having a volume fraction of at least 33%, the austenite having a lath shape, a short side of which is less than 350 nm.

2. The method according to the claim 1, wherein the steel slab further includes at least one selected from the group consisting of, by weight percent, 0.01 to 1.0% Cr, 0.005 to 0.3% Mo, and 0.001 to 0.1% Nb.

3. The method according to claim 1 further comprising galvanizing or galvannealing the steel sheet after quenching and annealing.

4. The method according to claim 2 further comprising galvanizing or galvannealing the steel sheet after quenching and annealing.

* * * * *